US005511898A

United States Patent [19]

Pettesch et al.

[11] Patent Number: 5,511,898

[45] Date of Patent: Apr. 30, 1996

[54] MOVEABLE MANHOLE COVER

[75] Inventors: Martin C. Pettesch, Cranford; Michael P. Breheny, Maywood; Christopher M. Andrews, Denville; Thomas G. Nelson, Basking Ridge; Joseph V. Milo, Rockaway Boro, all of N.J.

[73] Assignee: Universal Valve Co., Inc., Elizabeth, N.J.

[21] Appl. No.: 320,295

[22] Filed: Oct. 11, 1994

[51] Int. Cl.[6] ..... E02D 29/14

[52] U.S. Cl. ..... 404/25; 52/20

[58] Field of Search ..... 404/25, 26; 52/19, 52/20

[56] References Cited

U.S. PATENT DOCUMENTS 1,033,448 7/1912 Mueller ..... 404/26 X

FOREIGN PATENT DOCUMENTS 169403 7/1986 Japan ..... 404/25
176721 8/1986 Japan ..... 52/20
207727 9/1986 Japan ..... 52/20
162940 9/1933 Switzerland ..... 404/26
247943 1/1948 Switzerland ..... 52/19

*Primary Examiner*—David J. Bagnell
*Assistant Examiner*—James A. Lisehora
*Attorney, Agent, or Firm*—Edward Dreyfus

[57] ABSTRACT

A manhole includes a carriage mounted on the underside of the cover that cooperates with a supporting guide channel located across the mouth of the manhole. the guide channel can be rotated to an incline so that the carriage can easily roll onto and from the supporting guide member. The free end of the guide channel is raised and lowered by a standard ratchet wrench inserted through the cover so that the operator need not lift any part of the cover manually. Once raised to the ready position, the operator simply pulls laterally on the cover handle to roll the cover slightly upward and laterally from the manhole opening. Once the cover clears the manhole, the guide channel can be rotated up and outward to provide access to the entire manhole area , if desired. To replace the cover, the guide channel is rotated to again extend across the manhole, the cover/carriage assembly is rolled laterally on to the guide channel until the cover edge contacts the ring edge. The channel is then lowered with use of the tool to seat the cover on to the manhole ring. The operator at no time manually lifts the cover. The guide channel precisely orients the cover when moved to the closed position.

13 Claims, 5 Drawing Sheets

MOVEABLE MANHOLE COVER

BACKGROUND

The present invention relates to manhole covers and more particularly to covers having a system for moving the cover to and from a closing position over the manhole.

Manholes comprise three basic elements, namely, a ring serving as a top lip of the manhole, a skirt connected to and below the ring to form a partially enclosed chamber or hole, and a cover to cooperate with the ring for removably covering the chamber.

The size and weight of manhole covers have increased throughout the last several decades. Today, 36, 42, and 48 inch diameter or cross length are common with thickness of ½ and ⅜ (stiffened) inches. Covers are usually made of diamond plate steel and can weigh as much as 100 pounds.

Many techniques for raising and moving manhole covers have been tried to aid the operator. Bars, levers, frames, and hoists have all been tried but with essentially no acceptance in the field primarily because of the bulk and size of these aids that require movement and storage at the station or on the service truck.

Therefore, large covers today are still manually raised and dragged to the side, causing risk of injury to the operator. Also, because many covers have precisely positioned features, the operator must replace the cover in a precise angular position over the manhole, which is quite difficult with an unaided cover.

SUMMARY OF AN EXEMPLARY EMBODIMENT OF THE PRESENT INVENTION

The present invention provides a manhole and cover in combination with apparatus that solves the above mentioned problems and provides additional benefits and advantages over the prior art. One embodiment, according to the principles of the present invention, a carriage mounted on the underside of the cover that cooperates with a supporting guide member located across the mouth of the manhole and that can be rotated to an incline so that the carriage can easily roll onto and from the supporting guide member.

One end of the member can be raised and lowered by a ratchet type tool inserted through the cover so that the operator need not lift any part of the cover manually. Once raised to the ready position, the operator simply pulls laterally on the cover handle to roll the cover slightly upward and laterally from the manhole opening. Once the cover clears the manhole, the member can be rotated up and outward to provide access to the entire manhole area , if desired.

To replace the cover, the member is rotated to again extend across the manhole, the cover/carriage assembly is pushed laterally on to the member until the forward cover edge contacts the ring edge. The member is then lowered with use of the tool to seat the cover on to the ring.

It will be understood that the operator at no time lifts the cover, the only forces applied are substantially lateral pushing and pulling forces or forces developed with the use of a ratchet tool. Also, the support and guide member cooperate with the carriage to precisely orient the cover when moved to the closed position.

Other benefits and advantages will be seen from the following detailed description when taken in view of the appended drawings, in which.

DETAILED DESCRIPTION OF PREFERRED EMBODIMENT

Figure 1:
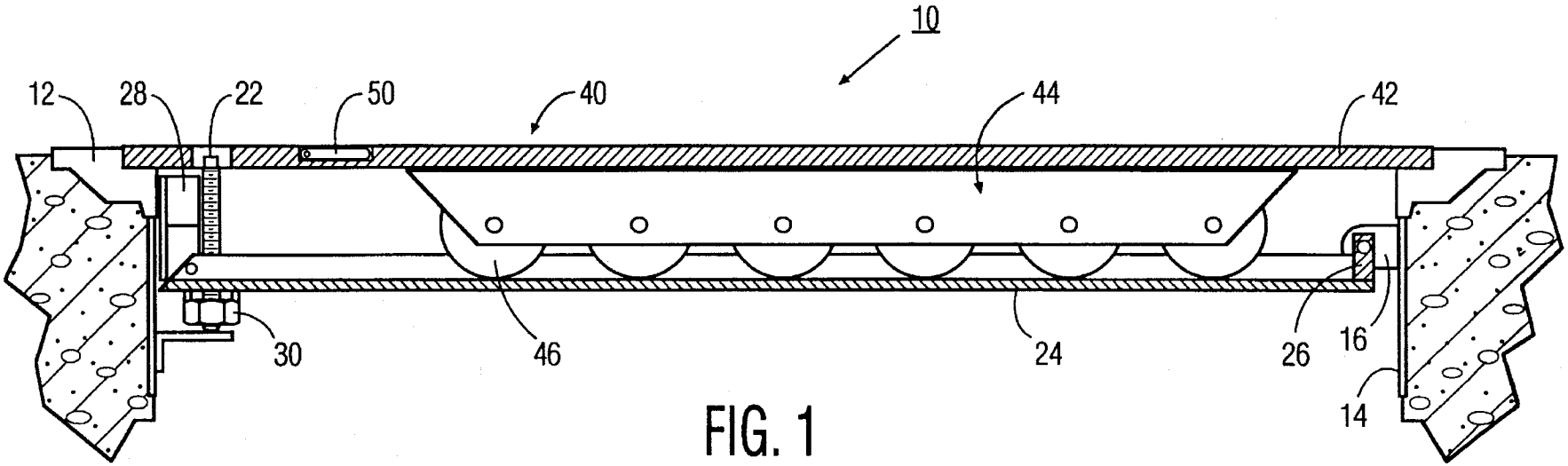
FIG. 1 is a partial side section of the manhole according to the principles of the present invention.

With reference to the figures, a manhole 10, according to the principles of the present invention, comprises a top ring or lip 12 and skirt 14 extending therebelow. Bracket 16 and L-shaped flange 18 are welded or otherwise secured to the skirt inside wall, generally as shown. These parts should have thickness and strength to support the cover assembly as described below. A threaded jack or bolt 20 has its top end 22 shaped to cooperate with a tool, not shown, which serves to rotate bolt 20. In one example, end 22 is shaped as a hexnut and cooperates with a standard ratchet or socket wrench. Bolt 20 is threaded onto a nut 30 secured to the bottom of the free or forward end of the channel guide 24, described below. The top threads of bolt 20 have a stop to prevent bolt 20 from disengaging from nut 30. The bottom of bolt 20 is flat and simply contacts flange 18 but is free to rotate regardless of said contact.

Manhole assembly 10 further includes a cover supporting a guide channel 24 having its back end 26 mounted for rotation on bracket 16, A small bridge or ramp 28 is pivoted to the front end of guide 24 side walls, generally as shown. Ramp 28 also includes side walls that flare outward toward its free end.

The bottom of channel 24 also defines opening 32 to accommodate access to the top of bolt 20.

Manhole 10 further comprises a lid or cover assembly 40 that includes a steel or other suitable material cover 42 and a carriage assembly 44 secured to the under side of cover 42. Assembly 44 comprises a pair of side walls 46 and a number of wheels or rollers 46 mounted on axles 48, Cover 40 also includes a handle that normally rests below the top surface of cover 42 and can be manually lifted to apply lateral forces to assembly 40.

In operation, with manhole 10 in its closed state, FIG. 1, cover 42 is supported by top ring 12. Channel 24 front end rests in its lower most position and ramp 28 is generally upright below cover 42.

To remove cover assembly 40, a ratchet wrench (not shown) is inserted to engage bolt top 22 and rotated clockwise. Bolt 20 rotates within nut 30 to raise the front end of guide 24 which in turn raises the left side of cover 42. Molt 20 rotation continues until ramp 28 pivots from its own weight onto ring or lip 12, as shown. After the tool is withdrawn, the operator can now raise handle 50 and simply pull to roll cover assembly 40 along guide 24, across ramp 28 and onto the adjacent surface.

Figure 3:
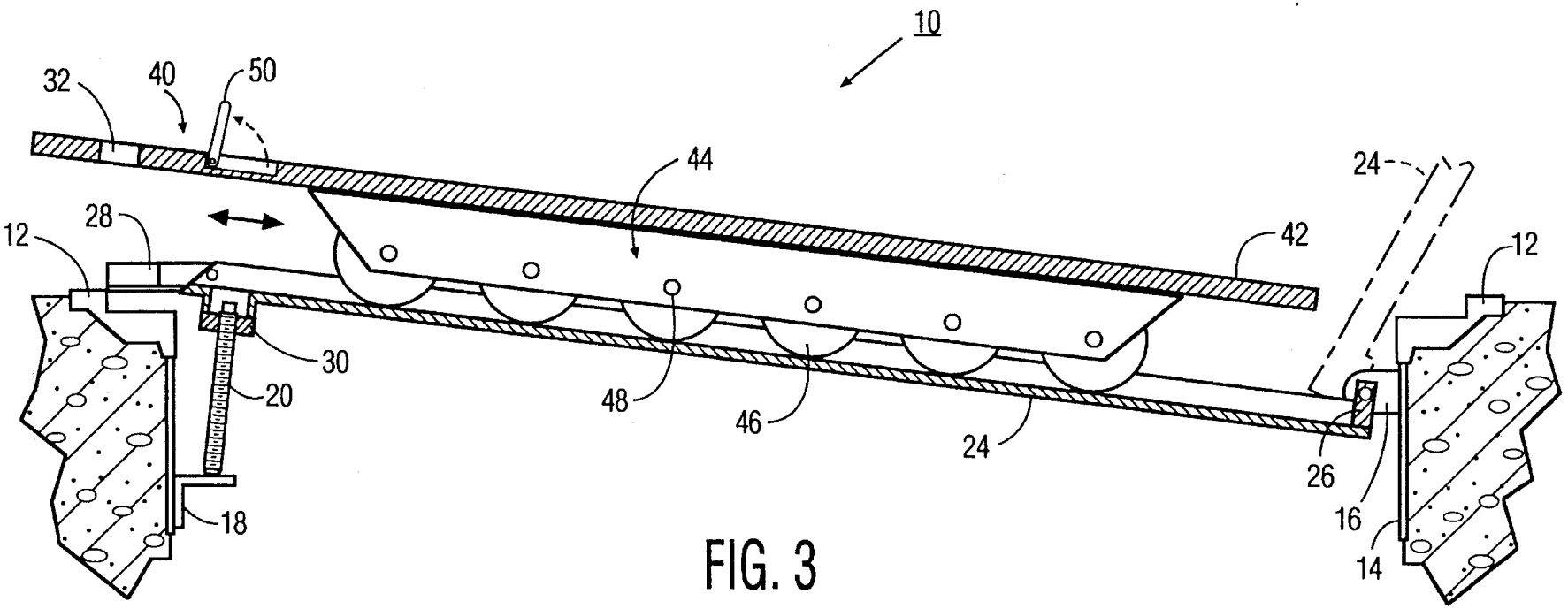
Figure 4:
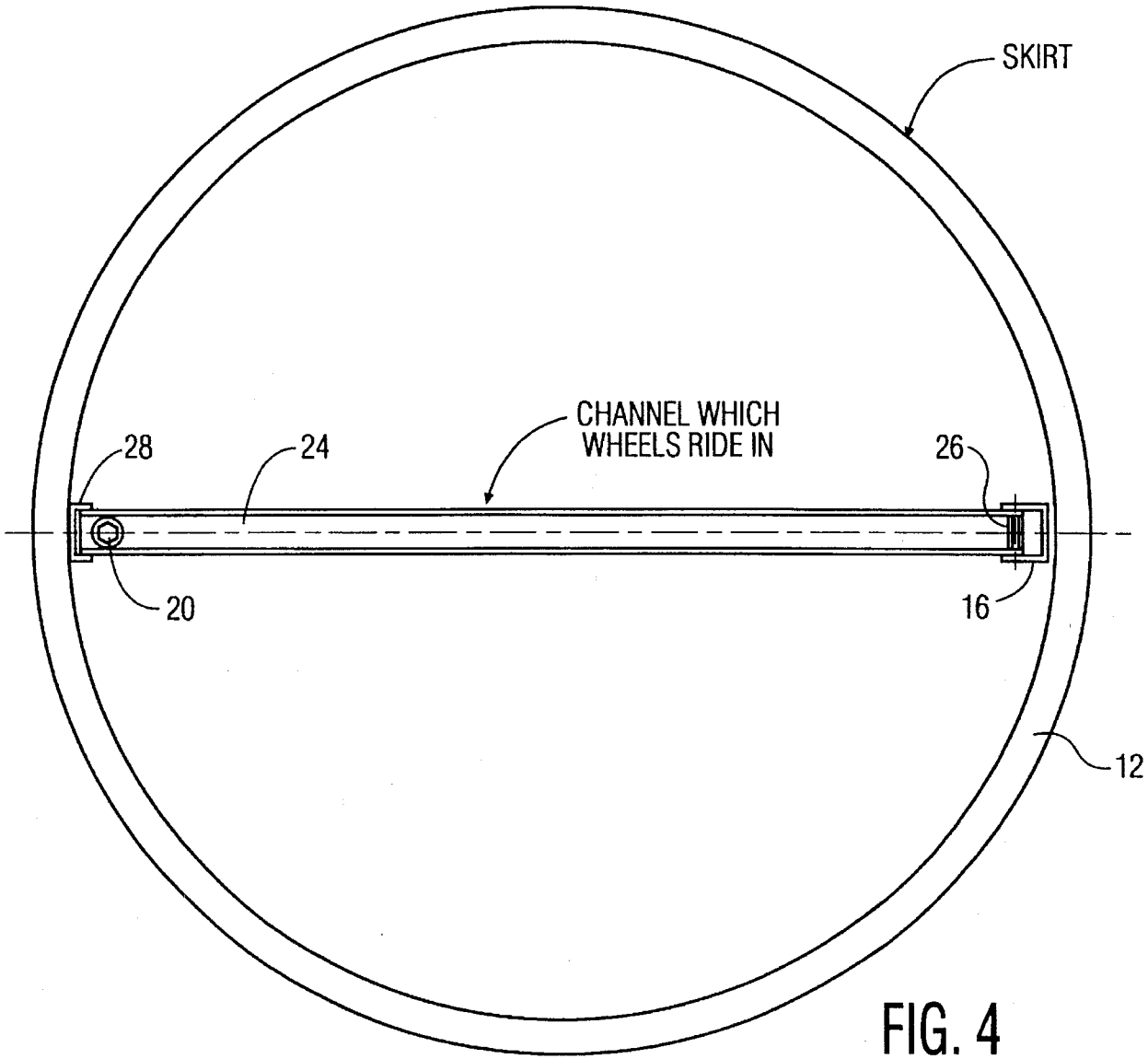
FIG. 4 is a top plan view of the manhole with the cover removed.
Figure 5:
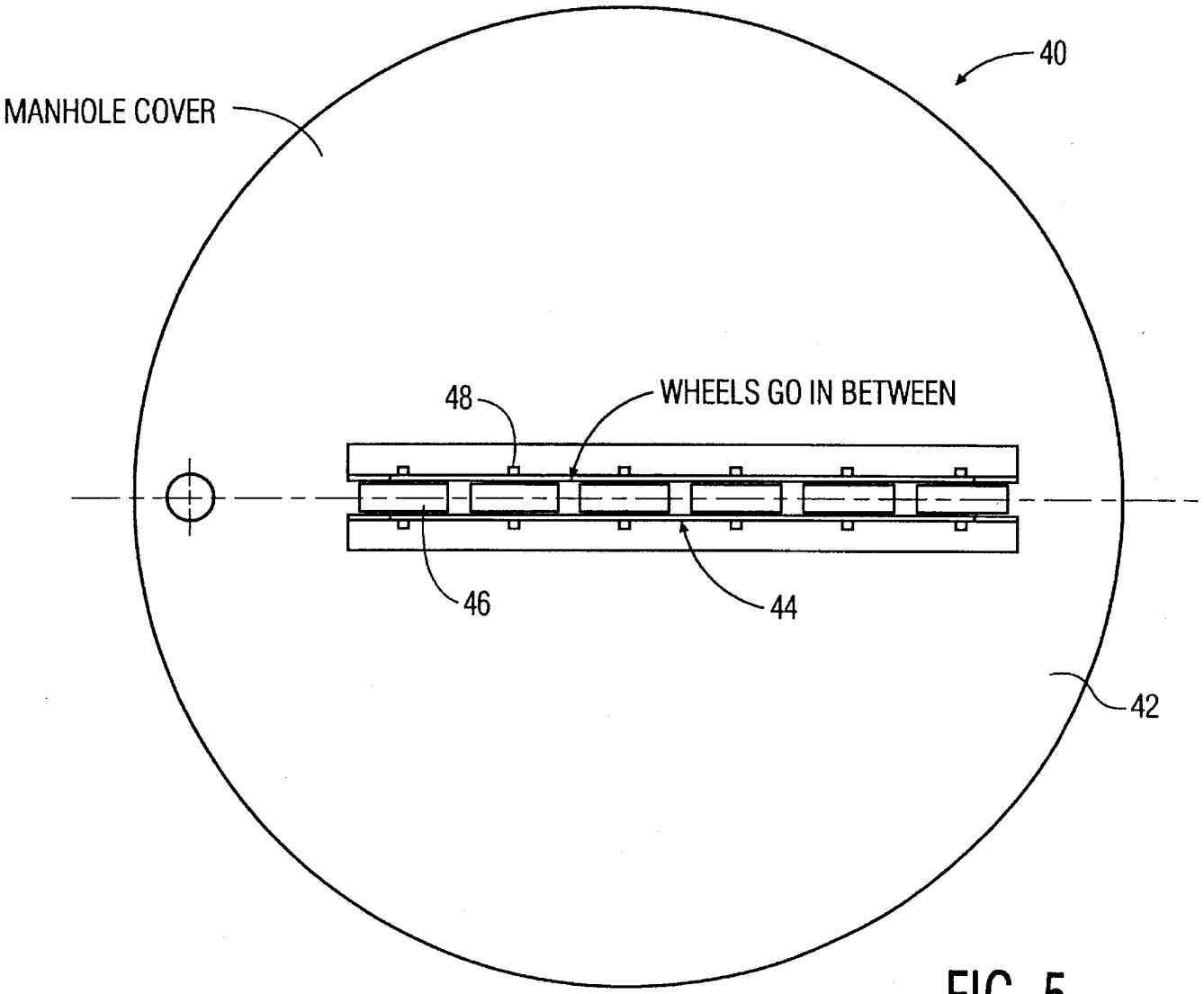
FIG. 5 is a bottom plan view of the cover assembly.

The operator can now have access to the chamber within skirt 14. If desired, channel 24 can be rotated out of the manhold to the position shown in phantom in FIG. 3.

Figure 2:
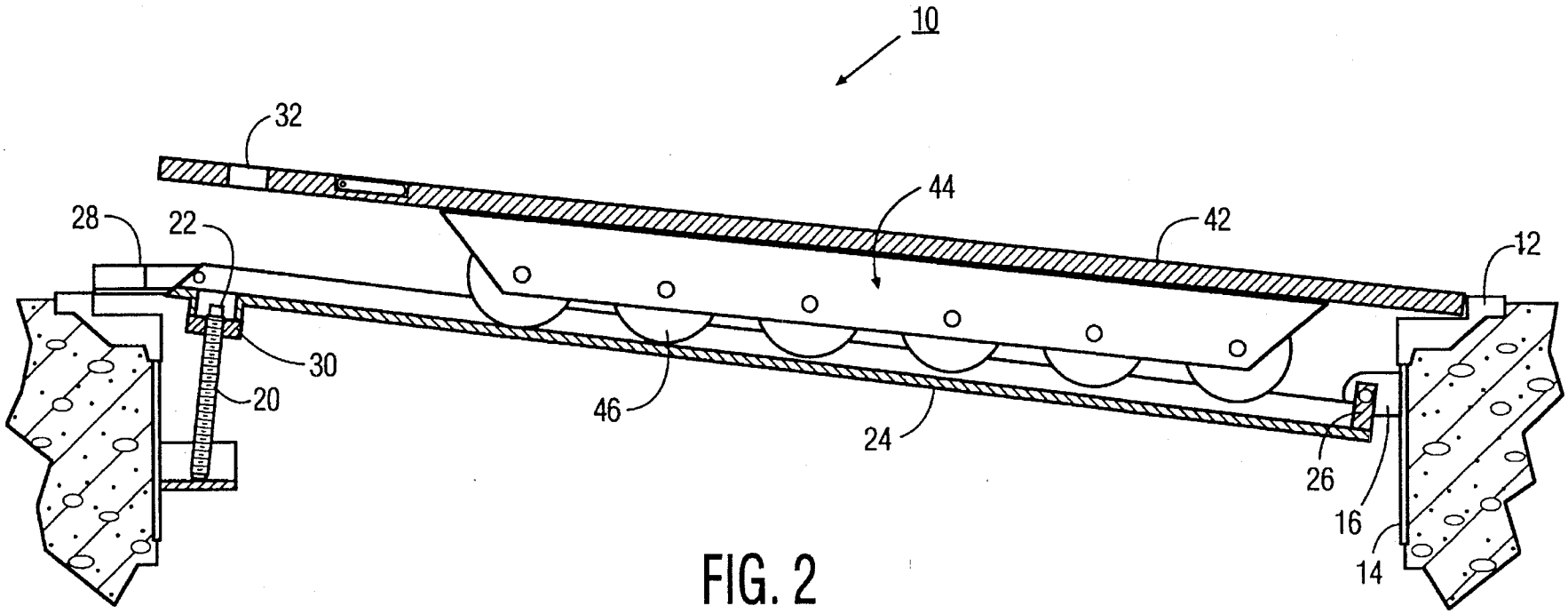
FIGS. 2 and 3 are views similar to FIG. 1 with the parts at different positions as described below.

To close the manhole, guide 24 is rotated so that bolt 20 contacts flange 18 and ramp 28 rests on lip 12. The Operator pushes the cover laterally to roll wheels 46 onto ramp 28. The flared forward side walls of ramp 28 aid in guiding the carriage 44 onto channel guide 24. cover assembly continues rearward until cover 42 engages the inside edge of top ring 12. (See FIG. 2). The operator then inserts the tool and rotates bolt 20 counter-clockwise to lower the parts to positions shown in FIG. 1. Note ramp 28 rotates to an upstanding position below cover 42.

It should be understood that various changes and modifications can be made to the exemplary embodiment disclosed herein without departing from the spirit and scope of the present invention.

We claim:

1. A manhole for mounting substantially flush with and below an adjoining surface, said manhole comprising, a first part defining a partially enclosed chamber and having a top rim for mounting substantially flush with the adjoining surface and for defining a top opening for said chamber, a cover assembly including a cover for removably covering the top opening of the chamber, and supporting means coupled to said first part for selectively raising and lowering said cover assembly between a closed position in which the cover is supported by the top rim of said first part and a raised position in which the cover assembly is supported by said supporting means and is free to move laterally across said supporting means and said rim on to and become supported by the adjoining surface to expose the opening of the chamber in response to the application of lateral manual force on said cover assembly.

2. The manhole according to claim 1, wherein said supporting means comprises a device supported by said first part within the chamber for raising and lowering the supporting means, said device being able to be engaged by and operable by a tool from outside the manhole when the cover assembly is at or between said closed and said raised positions.

3. The manhole according to claim 1, wherein said supporting means comprises guide means extending at least partially across the chamber for guiding the lateral movement of said cover assembly in a predetermined direction relative to said first part.

4. The manhole according to claim 3, wherein said guide means comprises a guide channel having one part mounted for rotation relative to said first part and a free end means that rises and lowers when said guide channel rotates.

5. The manhole according to claim 4, wherein said free end means comprises an of said guide channel and a ramp mounted for rotation to said channel end for bridging the space between said end of said guide channel and the rim of said first part when said supporting means is in the raised position.

6. The manhole according to claim 5, wherein said cover includes a bottom surface and said ramp rotates to an upstanding position and rests below the bottom surface of the cover when the supporting means lowers the cover assembly to its closed position.

7. The manhole according to claim 4, wherein said guide channel extends across a major part of the chamber and includes a pair of spaced side walls for guiding the cover assembly, said cover assembly comprising a carriage assembly having at least two wheels aligned with each other for rolling on and off said guide channel and being guided by the side walls in a predetermined direction relative to said first means.

8. The manhole according to claim 4, wherein said supporting means comprises a device supported by said first part within the chamber for raising and lowering the free end means, said device being able to be engaged by and operable by a tool from outside the manhole when the cover assembly is at or between said closed and said raised positions.

9. The manhole according to claim 8, wherein said device comprises a first threaded member and said free end means comprises a second threaded member for raising and lowering said guide channel when one of said first or second threaded members is rotated.

10. The manhole according to claim 9, wherein said second threaded member can disengage from said first threaded member to enable said guide channel to rotate to a position in which substantially all of said guide channel extends outwardly from said first part.

11. The manhole according to claim 9, wherein said first part comprises a mount extending into said chamber and said first threaded member comprises a bolt member mounted up-right for rotation on said mount, said bolt member defining a shape for cooperating with a tool for rotating said bolt member.

12. The manhole according to claim 11, wherein said cover assembly defines an opening to enable the insertion of a tool for turning said bolt member.

13. The manhole according to claim 12, wherein said second threaded member comprises a nut member secured to the free end means of said guide channel.

* * * * *

UNITED STATES PATENT AND TRADEMARK OFFICE

CERTIFICATE OF CORRECTION

PATENT NO. : 5,511,898

DATED : Apr. 30, 1996

INVENTOR(S) : Pettesch, et al.

It is certified that error appears in the above-indentified patent and that said Letters Patent is hereby corrected as shown below:

Col. 3, line 46, after "an" insert "end"

Signed and Sealed this

Twenty-ninth Day of April, 1997

*Attest:*

*Attesting Officer*

BRUCE LEHMAN

*Commissioner of Patents and Trademarks*